United States Patent [19]

Ochs

[11] 4,103,203

[45] Jul. 25, 1978

[54] WAFER MOUNTING STRUCTURE FOR PICKUP TUBE

[75] Inventor: Stefan Albert Ochs, Lancaster, Pa.

[73] Assignee: RCA Corporation, New York, N.Y.

[21] Appl. No.: 504,355

[22] Filed: Sep. 9, 1974

[51] Int. Cl.[2] ..... H01J 31/38; H01J 29/02

[52] U.S. Cl. ..... 313/390; 313/366

[58] Field of Search ..... 313/94, 388, 371, 380, 313/384, 385, 386, 390, 383, 367, 374, 366, 365, 368, 370

[56] References Cited

U.S. PATENT DOCUMENTS

| | | | |
|---|---|---|---|
| 3,256,455 | 6/1966 | Saldi | 313/390 |
| 3,350,595 | 10/1967 | Kramer | 313/366 X |
| 3,458,782 | 7/1969 | Buck et al. | 313/367 X |
| 3,569,758 | 3/1971 | Horiuchi et al. | 313/368 |
| 3,576,392 | 4/1971 | Hofstein | 313/367 X |
| 3,725,711 | 4/1973 | Sadler | 313/367 |
| 3,793,571 | 2/1974 | Janssen | 313/367 X |
| 3,814,965 | 6/1974 | Matsumura et al. | 313/367 |
| 3,887,827 | 6/1975 | Katayama | 313/366 X |
| 3,899,709 | 8/1975 | Brown et al. | 313/390 |

FOREIGN PATENT DOCUMENTS

| | | |
|---|---|---|
| 1,279,276 | 6/1972 | United Kingdom. |
| 1,284,886 | 8/1972 | United Kingdom. |
| 1,361,000 | 7/1974 | United Kingdom. |

OTHER PUBLICATIONS

Engstrom et al., "The Silicon Return-Beam Vidicon – A High Resolution Camera Tube", RCA Review, vol. 33, Sep., 1972, pp. 501–516.

*Primary Examiner*—Robert Segal

*Attorney, Agent, or Firm*—Glenn H. Bruestle; Dennis H. Irlbeck

[57] ABSTRACT

A thin target wafer of silicon includes a light receiving surface which is mounted to an inner faceplate surface of a pickup tube envelope by an interposed region of transparent adhesive. The peripheral edge of the adhesive is sealed by a conductive sealant material to substantially prevent outgassing of the adhesive within the interior of the envelope. In one embodiment, a conductive sealant material is provided by which electrical contact from the wafer to an electrical connector, extending external to the envelope, is established.

A method of assembly of the wafer with the faceplate is provided wherein residual bubbles of the interposed flowable adhesive are substantially collapsed by assembly of the wafer and the faceplate in a vacuum, and, thereafter, exposing the wafer-faceplate assembly to atmospheric pressure.

8 Claims, 4 Drawing Figures

WAFER MOUNTING STRUCTURE FOR PICKUP TUBE

BACKGROUND OF THE INVENTION

The invention relates generally to wafer mounting structures for pickup tubes.

In certain types of pickup tubes, such as camera tubes, a thin wafer of a semiconductor, or other material, is mounted within an end portion of an evacuated tubular envelope. For example, in the silicon vidicon, an extremely thin target wafer of silicon is ordinarily mounted proximate and parallel to a transparent light receiving faceplate portion of an evacuated envelope.

Various structures have been employed in the prior art to mount such target wafers, with a varying degree of success. The prior art structures and methods have generally employed specially formed retaining rings, and/or spring mounting means, requiring costly and time consuming assembly and/or alignment operations.

In operational respects, such prior art structures have also proven deficient. For example, with such structures, vibration of the central portion of the wafer may occur whenever the tube is subjected to vibration or shock. In this manner, microphonics may be introduced during the operation of the tube. For this, and other reasons, tubes utilizing such mounting structures have often been restricted in the degree of shock or vibration to which they could be subjected and yet remain operational.

SUMMARY OF THE INVENTION

A thin wafer includes a light receiving surface portion which is mounted to an inner faceplate surface of a pickup tube envelope by an interposed region of transparent adhesive. A sealant material is applied or deposited, over the peripheral edge of the adhesive material to substantially cover peripheral surface portions of the adhesive, not in contact with the faceplate or wafer, to avoid outgassing of the adhesive within the interior of the envelope.

A method of assembly of the wafer to the faceplate is disclosed wherein residual bubbles within the interposed regions of adhesive are substantially collapsed. In the method, the faceplate and wafer are assembled together, within a vacuum, with flowable adhesive therebetween. The faceplate-wafer assembly is thereafter exposed to atmospheric pressure. The interposed region of adhesive is then set or hardened.

DESCRIPTION OF THE PREFERRED EMBODIMENT

Figure 1:
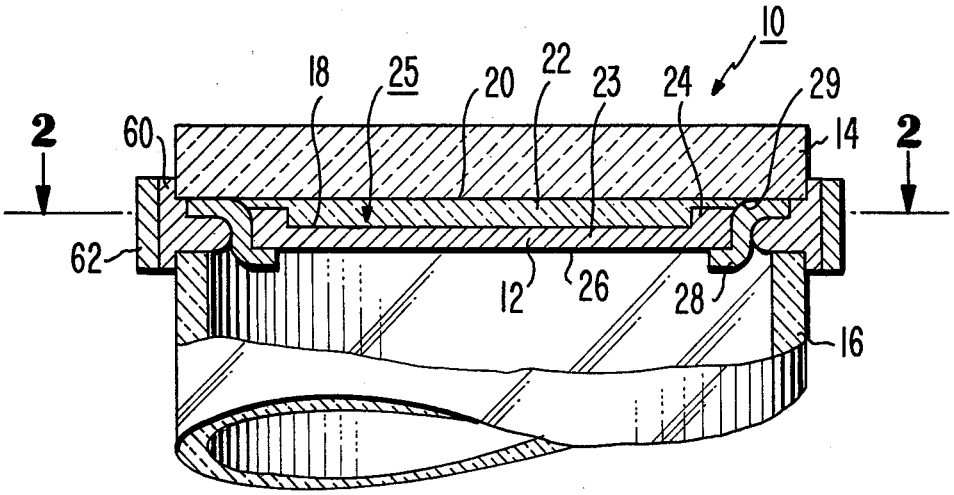
FIG. 1 is an exaggerated cutaway view of a pickup tube having a target wafer mounted to the faceplate in accordance with the invention.
Figure 2:
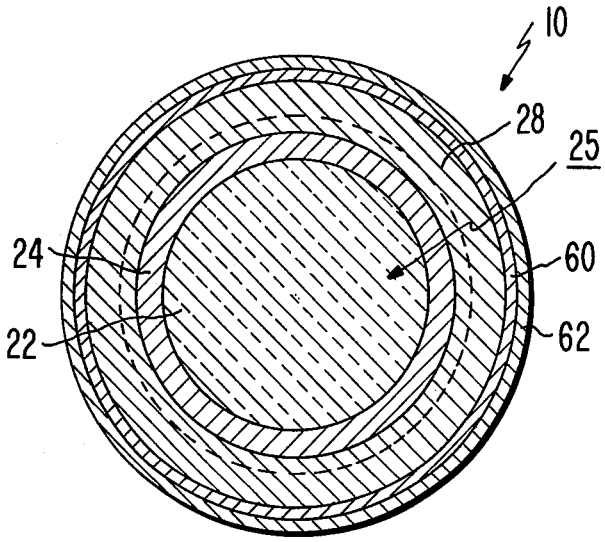
FIG. 2 is a cross sectional view of the pickup tube of FIG. 1 taken along lines 2—2 of that Figure.

Referring to FIGS. 1 and 2, there is shown a partial cutaway view of a pickup tube target mounting structure 10 wherein a thin wafer 12 of, for example, silicon is secured directly to a substantially flat transparent faceplate 14. The faceplate 14 is mounted in an assembly operation to a tubular end portion 16, as hereinafter clarified, to form a hermetically sealed envelope, or bulb, of the type well known in the art.

The thin silicon wafer 12 includes a light receiving surface 18 which interfaces with and is sealed to an inner faceplate surface 20 by means of an intermediate region of a highly transparent adhesive 22 interposed between the faceplate 14 and wafer 12. The wafer 12 includes an extremely thin centrally located annular portion 23 having a thickness of, for example, about 10 microns, and a thickened peripheral portion 24 having a thickness of, for example, about 125 microns. The light receiving surface 18 of wafer 12 comprises a major surface of the centrally located portion 23 which faces the faceplate 14. Light receiving surface 18, together with adjoining surface regions of the thickened portion 24 form a dish-like major surface of the wafer 12 which faces the faceplate 14 and includes a cavity 25 within which adhesive 22 is provided.

The wafer 12 also includes a major surface 26 which is not attached or secured by adhesive 22 to the faceplate 14. An annular conductive sealant ring 28, or coating, is provided on: an annular peripheral portion of surface 26, an annular peripheral portion of the inner faceplate surface 20, and the peripheral edges of the wafer 12. The sealant ring 28 also covers the annular peripheral edge portion 29 of the adhesive 22 which would otherwise be exposed, in a structure not including the ring 28 or a suitable alternative sealant, to the evacuated interior of the tube, along, or about, the peripheral edges of the wafer 12.

Selection of material compositions of adhesive 22 and conductive sealant ring 28 is particularly critical. The adhesive 22 must be highly transparent (i.e. capable of transmitting in excess of 75% of the incident light) to permit substantially unobstructed passage of light from the faceplate 14 to the light receiving surface 18 of the assembled pickup tube. The adhesive 22 must also be substantially devoid of discontinuities such as, for example, bubbles which exceed in dimension the desired resolution capabilities of the pickup tube on the order of 10 microns, or which would otherwise distort the light image incident upon the light receiving surface 18. The adhesive 22 should also be compatable with the optical qualities of the faceplate 14, such as, for example, its index of refraction.

The adhesive 22 preferably comprises a low vapor pressure material which provides a minimum of contamination of the evacuated tube interior. Such contamination may be caused, for example, by outgassing of the material within the evacuated tube after assembly. Also, the adhesive material 22 must be capable of sustaining the above-described qualities during and subsequent to processing temperatures, to which that material may be subjected during tube assembly, and which may approach or exceed 150° C. Lastly, the adhesive qualities of adhesive 22 must be adequate to retain the wafer 22 secured to the faceplate 14 even when the assembled device is subjected to above normal vibration and shock.

The adhesive 22 preferably comprises a cured epoxy adhesive material such as, for example, an "ARALDITE" 502 epoxy resin mixed with epoxy hardener no. 951 in approximately a 10 to 1 proportion. Both of these materials are available from CIBA Products Company of Summit, New Jersey. This adhesive possesses a high transparency to incident light which permits passage of in excess of 95 percent of the incident light, for a thickness of less than 0.2 mm. preferably used in mounting the wafer 12 to the faceplate 14, in the manner shown in FIGS. 1 and 2.

Alternatively, the adhesive 22 may comprise a cured epoxy such as a "Maraglas" crystal clear thermosetting plastic epoxy resin no. 655, mixed with a suitable proportion of no. 555 hardener which are available from the Marblette Corporation of Long Island City, New York. Other suitable highly transparent adhesive materials may be utilized to advantage so long as the previously described material characteristics are adequate for the application.

The adhesive 22 preferably comprises a material composition which, when cured, or otherwise hardened, will not contaminate the interior of an evacuated tube within which it is incorporated. In most cases, however, certain amounts of outgassing occurs from the cured, or otherwise hardened, adhesive 22 which could destroy or otherwise seriously impair the operation of an evacuated tube, assembled in the manner described. For this reason, a sealant material in the form of the sealant ring 28 is provided to entirely cover, or substantially cover peripheral edge portions 29 of the adhesive 22 to substantially avoid outgassing of that material within the evacuated interior of an assembled pickup tube. To accomplish this function, the material of the conductive sealant ring 28 must consist of an extremely low vapor pressure sealant material. Preferably, the material of ring 28 is also conductive. One such material is "EPO-TEK" H44, an electrically conductive gold adhesive epoxy, available from Epoxy Technology, Inc. of Watertown, Massachusetts.

The thickness of the material of the sealant ring 28 is chosen for its ability to substantially seal the evacuated interior of the assembled evacuated tube from possible contamination by outgassing of the adhesive 22. Preferably, sufficient sealant material, such as "EPO-TEK" 44, is deposited about the peripheral edge surface of the wafer 12 to completely cover any surface portion 29 of the adhesive 22 which would be exposed within the interior of the tube were it not for the inclusion of the sealant ring 28.

The sealant material which comprises the ring 28 might also consist of, for example, a metal or a conductive cermet material composition having acceptable low vapor pressure characteristics, appropriate application temperatures, and adequate adherence qualities.

A sealant material is preferred for the ring 28 which is conductive, since it permits a simple and expedient method of establishing an electrical connection between the wafer 12 and an electrode extending external to the envelope of the assembled device, as hereinafter clarified.

While a conductive sealant material is preferred for the composition of ring 28, non-conductive materials, having otherwise desirable characteristics, may be utilized to advantage. For example, nonconductive epoxy or glass compositions might be employed to advantage whenever a suitable alternative electrical connection is provided to the exterior of the envelope. Suitable nonconductive low vapor pressure materials are for example: a high vacuum cement such as "Silvac" available from Curtis Associates of San Diego, California; or a bakeable high vacuum leak sealant such as "Siltorr" also available from the same source.

Figure 3:
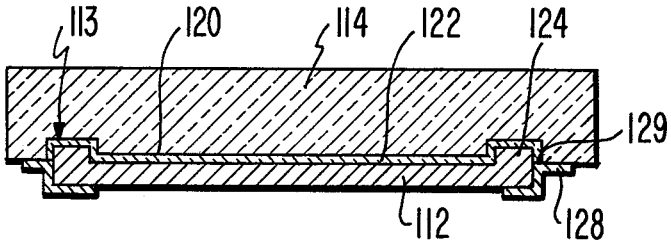
FIG. 3 is a cross sectional view of an alternative embodiment of a target-faceplate assembly of a pickup tube made in accordance with the invention.

Numerous structural variants of the embodiment depicted in FIGS. 1 and 2 may be accomplished without deviating from the inventive concept. Referring to FIG. 3, there is shown one structural variant, wherein similar numerical designations depict analogous structural components to those depicted in FIG. 1, in which thickened peripheral portion 124 of wafer 112 is positioned within a channel 113 formed into an inner faceplate surface 120 of faceplate 114.

One example of a method of mounting the wafer 12, on the faceplate 14, as shown in FIGS. 1 and 2 is as follows:

Preliminary to assembly, the faceplate is cleaned to insure that the inner faceplate surface 20 upon which the wafer 12 is mounted does not include particles of material which would affect the adhering qualities of adhesive 22, and/or introduce undesirable discontinuities into the light transmitting region of the assembled tube.

A sufficient mass of the non-cured adhesive 22 is prepared in flowable or viscous form in accordance with the recommended directions of the manufacturer or supplier. Preferably, this mass is thereafter placed within an evacuated chamber for a period of time sufficient to remove as many bubbles from the material as possible without permitting the material to cure or harden. It is essential that the adhesive 22, prior to assembly, remain flowable.

Figure 4:
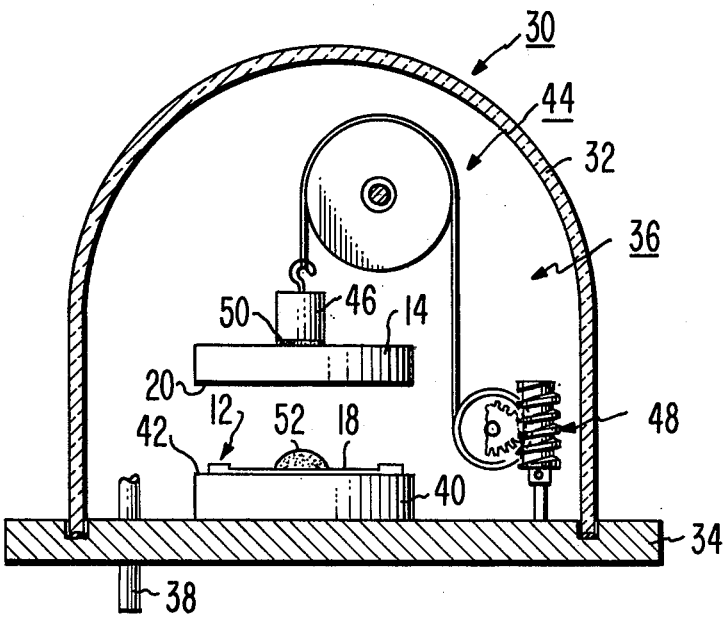
FIG. 4 is a cross sectional view of an apparatus for assembly of a target and faceplate in accordance with the invention.

Referring to FIG. 4, one simplified embodiment of an apparatus 30 is shown for mounting a wafer 12 to a faceplate 14. The apparatus 30 comprises a removable vacuum containing enclosure 32 sealed to a base support member 34. An interior cavity 36, of the vacuum containing enclosure 32, is evacuated to a pressure of, preferably less than $10^{-3}$ torr. Evacuation of cavity 36 is accomplished by means of a vacuum pump system suitably interconnected to a tubulation 38 which is hermetically sealed through the base member 34. A wafer support block 40 is anchored on the base member 34 within cavity 36. The block 40 includes a substantially flat top surface 42 adapted to receive the thin wafer 12.

A conjoining means is included within the cavity 36 for providing movement of the faceplate 14 toward the wafer 12 and for providing a conjoining force therebetween. The conjoining means includes a mechanical arrangement for moving the inner faceplate surface 20 relative to the light receiving surface 18 of the wafer 12. In the apparatus 30, this means comprises a pulley arrangement 44 in which a weighted faceplate retaining member 46 is vertically movable, substantially perpendicular to the light receiving surface 18 of a wafer 12, mounted on block 40 by means of a drive gear assembly 48 operable external (not shown) to the apparatus 30. The weighted faceplate retaining member 46 includes a weight having an adhesive surface 50 capable of fixably retaining the faceplate 14 in substantially aligned parallel spaced apart relation to the light receiving surface 18 of the wafer 12.

During assembly, the wafer 12 is mounted on the block 40, and the faceplate 14 is mounted on adhesive surface 50 of the weighted member such that its inner surface 20 is spaced-apart substantially parallel to the light receiving surface 18 of wafer 12. Thereafter a globular mass 52 of the flowable adhesive, prepared as previously described to include a minimum of bubbles, is centrally placed upon the light receiving surface 18 of wafer 12. The removable vacuum containing enclosure 32 is thereafter placed in position on the base member 34 and the cavity 36 is evacuated. After the cavity 36 has been evacuated and a suitable period of time has elapsed for removing bubbles in the mass 52, the weighted faceplate retaining member is slowly moved downward. The light receiving surface 18, of wafer 12, and the inner faceplate surface 20 are thereby slowly moved closer together in substantially parallel relation to each other. As the surfaces 18 and 20 become closer to each other, the flowable adhesive mass 52 moves radially outward to completely fill the region between the two parallel surfaces. The movement of the adhesive 52 radially outward is accomplished partially by the force exerted against the interposed adhesive 52, and partially by capillary forces formed between the surfaces 18 and 20. The faceplate 14, with the wafer 12 loosely attached thereto, is thereafter subjected to atmospheric pressure by introducing air, or other suitable gas, within the cavity 36. The faceplate-wafer assembly may then be carefully removed from the apparatus 30 to perform additional assembly operations thereon.

Importantly, once atmospheric pressure is exerted against the two loosely attached members, most residual bubbles within the transparent adhesive 22 substantially collapse to define dimensions, in a plane parallel to the light receiving surface 18, which are generally less than 10 microns.

The adhesive 22, between the assembled wafer 12 and faceplate 14, is thereafter set, or hardened, as, for example, by curing the adhesive 22 in a suitable environment which depends upon the curing properties of material selected. Once a suitable curing operation has been completed, the wafer 12 is fixably mounted upon the inner surface 20 of faceplate 14 by the cured adhesive 22.

The sealant ring 28 may be formed, prior to, during, or subsequent to the hardening of the adhesive 22. In assembly, a suitably prepared and adequate quantity of sealant material, such as one of the previously described sealant materials which are preparable in a viscous form, may be applied mechanically, as for example, by brush application. In the case of one of the previously described solid materials, application may be accomplished by sputtering or other techniques well known in the art, for applying or depositing solid materials to a base surface. If a flowable or viscous material is utilized for the material composition of the ring 28, that material is thereafter set, or hardened, as, for example, by curing in a suitable environment.

The processing temperatures used in depositing, applying and/or setting of the adhesive material 22, or sealant material of ring 28, must not exceed the maximum temperatures to which the wafer may be subjected without affecting its essential characteristics. For example, a silicon wafer utilized in a vidicon camera tube ordinarily must not be subjected to temperatures exceeding about 300° C. for any substantial length of time.

In addition to providing a vacuum sealant for the adhesive 22, the material of ring 28, if conductive, may also be applied, or deposited in a manner which provides an electrical connection from the wafer 12 to an electrical connector extending external to the envelope. This additional function may be simply and expeditiously achieved by providing an electrically conductive sealant material composition for the ring 28. In such an embodiment, the sealant material of ring 28 is applied, or deposited, to also cover the peripheral edges of the wafer 12 and an annular peripheral portion of the inner faceplate surface 20. In this manner, for example, a convenient electrical connection to the wafer 12 may be achieved external to the envelope by incorporating this faceplate and wafer assembly in a structure such as shown in FIG. 1. In that structure, the faceplate and wafer assembly is hermetically sealed to the tubular end portion 16 of an envelope by means of the indium ring 60 which makes electrical contact with the conductive sealant ring 28 and metallic signal ring 62. An indium ring seal of similar construction is, for example, fully described in U.S. Pat. No. 2,984,759 issued to B. H. Vine on May 16, 1961. Other connector means may be suitable provided, in lieu of the indium ring 60 to provide a means whereby an electrical connection may be established to the ring 28 from the exterior of the tubular envelope, in a manner well known in the art. One such alternative embodiment might, for example, comprise a structure wherein external electrical contact to the ring 28 is established by means of a kovar pin hermetically sealed through the sidewall end portion of an envelope.

The mounting structure above described is simpler and less costly to assemble than prior art structures. Pickup tubes assembled in the described manner are particularly rugged and their operation is less subject to operational deficiencies caused by shock and/or vibration. The light receiving surface is itself firmly mounted by the adhesive 22 against the inner faceplate surface 20. Proper selection of the transparent adhesive 22 permits these advantages to be obtained while minimally affecting the intensity of the incident light, or image, incident upon the light receiving surface 18 of wafer 12.

The mounting structure described may be incorporated in a "demountable faceplate structure" such as that shown in FIG. 1, or may be incorporated in a tubular envelope including, integrally therewith, a transparent faceplate end portion. In the case of the demountable faceplate structure depicted in FIGS. 1–2, the novel faceplate and wafer assembly may be simply and expeditiously tested for flaws and defects prior to assembly with the other components of the pickup tube. Unlike prior art structures, the novel wafer mounting structure does not require a TIC coating, or transparent conductive layer, on the inner faceplate surface to achieve an electrical connection external to the envelope.

What I claim is:

1. A pickup tube comprising:

(a) an evacuated glass envelope having a transparent glass faceplate closing one end of said envelope;

(b) a wafer including a light receiving surface portion mounted to an inner surface of said faceplate by an intermediate layer of highly transparent adhesive, said layer of adhesive including a peripheral surface portion, not in contact with said wafer and faceplate, and extending about said light receiving surface portion of said wafer; and (c) a low vapor pressure sealant material extending over and substantially covering said peripheral surface portion of said adhesive to substantially prevent outgassing of said adhesive within the evacuated interior of said envelope, said sealant material being conductive and extending across a surface portion of said wafer to an electrical connector extending external to said envelope.

2. A pickup tube in accordance with claim 1, wherein said wafer is disc shaped, and said sealant material substantially comprises an annular ring.

3. A pickup tube in accordance with claim 2, wherein said wafer is composed of a semiconductor material including a thickened peripheral ring portion, and a thin portion which extends centrally across that ring portion.

4. A pickup tube in accordance with claim 3, wherein said thickened peripheral ring portion of said wafer is recessed within a receiving channel extending into the inner faceplate surface.

5. A pickup tube in accordance with claim 3, wherein said tube includes a cavity region, between said inner faceplate surface and the light receiving surface portion of the inner facing surface of said central thin portion, substantially filled by said adhesive.

6. A pickup tube in accordance with claim 5, wherein said adhesive comprises a highly transparent epoxy.

7. A pickup tube in accordance with claim 6, wherein said conductive sealant material comprises a low vapor pressure epoxy.

8. A pickup tube comprising:

(a) an evacuated envelope having a transparent faceplate closing one end;

(b) a wafer including a peripheral ring portion and a central portion; said central portion extending across said ring portion and being of lesser thickness relative thereto whereby said wafer includes a dish-like major surface; said major surface mounted to an inner surface of said faceplate by an intermediate layer of adhesive; said major surface including a central recessed light receiving surface portion which faces the inner surface of said faceplate and is spaced therefrom to form a central cavity therebetween; said central cavity being substantially filled with a highly transparent adhesive;

(c) a low vapor pressure sealant material extending over and substantially covering a peripheral surface portion of said adhesive to substantially prevent outgassing of said adhesive within the evacuated interior of said envelope, said sealant material being conductive and extending across a peripheral surface portion of said wafer to an electrical connector extending external to said envelope.

* * * * *